US006018848A

United States Patent [19]

Nilsen et al.

[11] Patent Number: 6,018,848

[45] **Date of Patent: *Feb. 1, 2000**

[54] BELT CLIP HAVING INTEGRATED ELECTRICAL CONNECTOR PROTECTIVE COVER RETENTION AREA AND METHOD OF USING SAME

[75] Inventors: Ryan M. Nilsen, Sunrise; Patrick J. Gillon, Plantation, both of Fla.

[73] Assignee: Motorola, Inc., Schaumburg, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/055,334

[22] Filed: Apr. 6, 1998

[51] Int. Cl.[7] ..... A45F 5/00; A44B 21/00

[52] U.S. Cl. ..... 24/3.12; 24/3.1; 24/3.11

[58] Field of Search ..... 24/3.1, 3.11, 3.12, 24/597, 458

[56] References Cited

U.S. PATENT DOCUMENTS

| | | | |
|---|---|---|---|
| 4,111,343 | 9/1978 | Selinko | 24/3.11 |
| 4,887,753 | 12/1989 | Allen | 24/3.11 |
| 5,016,326 | 5/1991 | Goldenberg | 24/3.11 |
| 5,385,282 | 1/1995 | Chen | 24/3.11 |
| 5,664,292 | 9/1997 | Chen | 24/3.12 |
| 5,678,281 | 10/1997 | Kamp et al. | 24/3.11 |
| 5,709,012 | 1/1998 | Ebashi | 24/3.12 |

FOREIGN PATENT DOCUMENTS

| | | | |
|---|---|---|---|
| 0139928 | 5/1985 | European Pat. Off. | 24/3.1 |

*Primary Examiner*—Victor N. Sakran
*Attorney, Agent, or Firm*—Frank M. Scutch, III

[57] ABSTRACT

A belt clip (100) use with an electronic device includes an attachment member (101) for securing the electric device to a fixed object such as a person's belt. The attachment member (101) includes a protective cover retention area (107) for enabling a protective cover (13), that is used as a port or dust cover for protecting unused electrical connectors, to be frictionally engaged therein.

8 Claims, 2 Drawing Sheets

BELT CLIP HAVING INTEGRATED ELECTRICAL CONNECTOR PROTECTIVE COVER RETENTION AREA AND METHOD OF USING SAME

TECHNICAL FIELD

This invention relates in general to two-way radios and more particularly to belt clips for holding the portable two-way radio.

BACKGROUND

Many portable electronic devices, such as two-way radio equipment, are commonly used by consumers as well as public service agencies. These persons may include police, fire and/or public utilities. In order to enable the user to easily carry the radio on their person, most portable two-way radio equipment includes a clip attached to a rear portion of the radio housing. This clip is typically used for attaching the radio to the user's belt, holster or other fixture where it can be easily accessed.

Moreover, many electronic devices, such as more complex two-way radio equipment discussed above, typically include one or more electrical connectors within the radio housing. These connectors are used for attaching peripheral devices to the radio such as microphones, speakers, antennas or external power supplies. In order to insure that moisture and debris does not penetrate or degrade the performance of the connector when not in use, a protective cover some refereed to as a "dust" or "port" cover can used to protect the connector. The port cover can be as simple as a small plastic insert that is inserted over or within the connector when not in use. This is more clearly shown in prior art FIG. 1, where the electronic device 10 includes an electrical connector 11 that is covered or protected by a protective cover 13 when not in use.

One method used to insure that the protective cover is not lost when removed is to attach a small lanyard to the cover. The lanyard attaches at one end to the cover while its opposite end is typically attached to another portion on the radio. This insures that the protective cover remains attached to the radio so that it can be reattached at a later time when the electrical connector is again exposed. The use of the lanyard may create a number of problems due to the loose and dangling nature of the lanyard assembly not to mention the cumbersome appearance of a protective cover hanging from the radio.

Thus, the need exists to easily store the protective cover to an electronic device, such as a portable two-way radio, without the need or additional expense of providing a protective cover lanyard connected to the radio.

DETAILED DESCRIPTION OF THE PREFERRED EMBODIMENT

Figure 1:
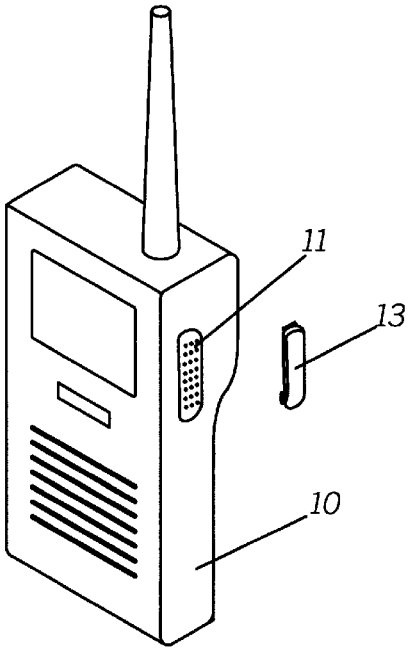
FIG.1 (PRIOR ART)
FIG. 1 is a partial exploded view showing a prior art electronic device using a protective cover for covering an electrical connector.
Figure 2:
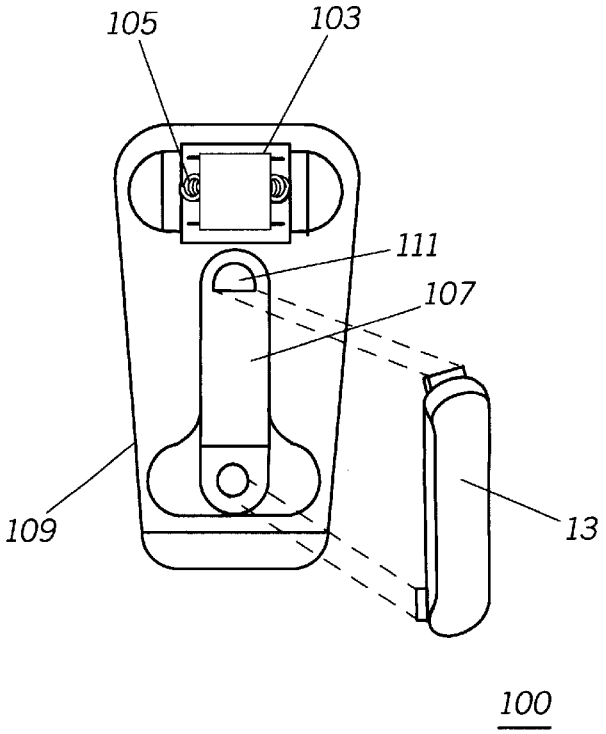
FIG. 2 is an exploded perspective view of a belt clip having an integrated electrical cover retention area according to the preferred embodiment of the invention.
Figure 3:
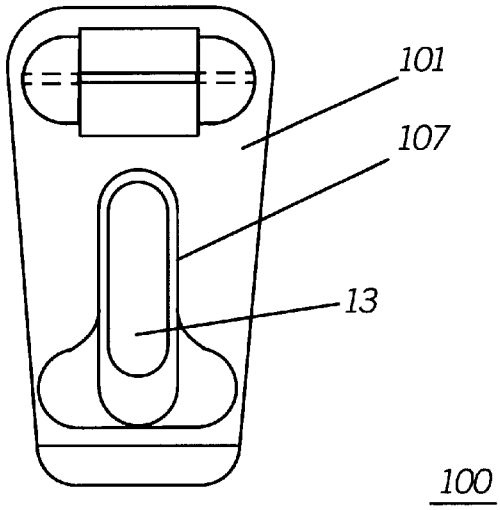
FIG. 3 is a rear view of the belt clip showing the protective cover engaged therein.
Figure 4:
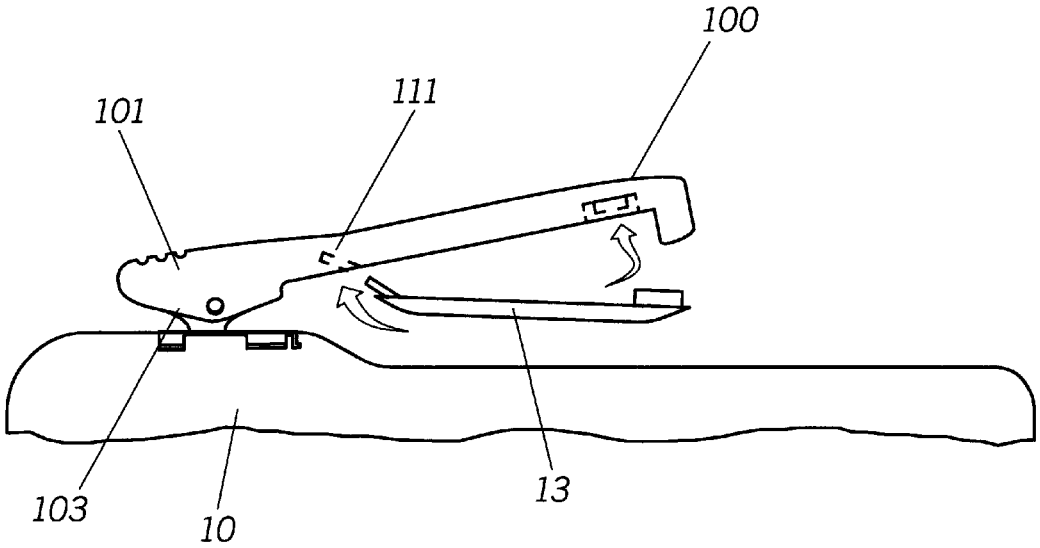
FIG. 4 is a side view of the belt clip showing engagement of the clip with a housing and the insertion of the electrical connector protective cover in the retention area.

Referring now to FIG. 2 through 4, the belt clip 100 having an integrated electrical connector cover retention area includes a rigid attachment member 101 that attaches to the housing of an electronic device and works to engage with a fixed body or rigid structure. The fixed body or rigid structure typically will be a user's belt, holster or other secure structure that will fixedly attach the electronic device to the user's person.

As seen in FIG. 4, the belt clip 100 may further include a fastener 103 and associated biasing device such as a spring 105 for providing a tension or biasing force between the attachment member 101 and the rigid structure. Thus, when the belt clip 100 is in use, the attachment member is forced against the fixed body, such as a user's belt, in order to securely hold the electronic device in position. This ultimately prevents lateral motion of the electronic device. The attachment member 101 is generally manufactured from a hard plastic it will be evident to those skilled in the art that attachment member can be manufactured from any type of rigid material and may be shaped or configured to best suit the electronic device and the user.

In order to avoid the use of a lanyard or other type of fixed attachment, that is most often required to prevent the protective cover 13 from being lost, the present invention includes a belt clip 100 with a retention area 107 that is recessed or integrated within a portion of the attachment member 101. The retention area 107 is formed by a cut-away or indented section of the attachment member 101. The retention area 107 may include one or more snap members 109 and/or apertures 111 for frictionally engaging with corresponding elements on the protective cover 13 for securely holding it in position.

As best seen in FIGS. 2 and 4, the protective cover 13 fits into the retention area 107 located on the underside of the belt clip 100. This acts to further provide a useful function allows the surface of the protective cover 13 where it acts to frictionally engage with the rigid body or surface when worn. Thus, in a typical example when the belt clip 100 is worn on the user's belt, the protective cover 13 further prevents motion of the electrical device due to side forces applied thereto since the frictional resistance of the protective cover 13 act to inhibit motion. Although shown on the underside of the belt clip 100, it will be evident to those skilled in the art that the retention area 107 can also be placed on the opposite or front side of the belt clip surface.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A belt clip for use with an electronic device comprising;

an attachment member for securing the electronic device to a fixed object; and a protective cover retention area located within recess means on the belt clip for enabling an electrical connector protective cover used for covering an exposed portion of an electrical connector when not in use on the electronic device to be frictionally engaged therein.

2. A belt clip as in claim 1, further comprising a fastener for attaching the belt clip to the electronic device.

3. A belt clip as in claim 2, wherein the fastener includes a retention spring for providing a force between the attachment member and fixed object.

4. A belt clip as in claim 1, wherein the electronic device is a portable two-way radio.

5. A belt clip assembly for attaching a portable two-way radio to a user comprising;

a rigid attachment member for engaging a fixed body; and a recess area integrated within an underside of the rigid attachment member for frictionally engaging with an electrical connector protective cover used for covering an electrical connector attached to the portable two-way radio when not in use and retaining it therein.

6. A belt clip assembly as in claim 5, further comprising a fastener for attaching the belt clip with the portable two-way radio.

7. A belt clip assembly as in claim 6, wherein the fastener utilizes a spring for providing a tension force between the rigid attachment member and the fixed body.

8. A belt clip assembly as in claim 5, wherein the recess area includes at least one retention aperture for engaging with a corresponding brace on the electrical connector protective cover and holding it into a fixed position.

* * * * *